US009516960B2

(12) United States Patent
Cooper

(10) Patent No.: US 9,516,960 B2
(45) Date of Patent: Dec. 13, 2016

(54) ORIENTATION DEPENDENT ILLUMINATION DEVICE FOR A DISPENSING CONTAINER

(71) Applicant: Curtis Bradwell Cooper, Carpinteria, CA (US)

(72) Inventor: Curtis Bradwell Cooper, Carpinteria, CA (US)

( * ) Notice: Subject to any disclaimer, the term of this patent is extended or adjusted under 35 U.S.C. 154(b) by 362 days.

(21) Appl. No.: 13/999,209

(22) Filed: Jan. 29, 2014

(65) Prior Publication Data

US 2014/0233215 A1 Aug. 21, 2014

Related U.S. Application Data

(60) Provisional application No. 61/850,614, filed on Feb. 20, 2013.

(51) Int. Cl.
*A47G 19/22* (2006.01)
*A47G 23/03* (2006.01)

(52) U.S. Cl.
CPC ..... *A47G 19/2227* (2013.01); *A47G 23/0309* (2013.01); *A47G 2019/2238* (2013.01)

(58) Field of Classification Search
CPC ..... A47G 2019/2238; A47G 23/0309; A47G 19/2227
USPC ..... 362/154
See application file for complete search history.

(56) References Cited

U.S. PATENT DOCUMENTS 7,088,258 B2 * 8/2006 Morrison ..... G01C 9/06 340/545.5
9,163,826 B1 * 10/2015 Citrin ..... A47G 19/2227
2009/0321458 A1 * 12/2009 Blair ..... A47G 19/2227 220/709
2014/0300273 A1 * 10/2014 LeBrun ..... G09F 23/06 315/76
2015/0359364 A1 * 12/2015 Sweeney ..... G01F 17/00 206/459.1

OTHER PUBLICATIONS

Screen captures from YouTube video clip entitled TipSEE WineBottle Demo, 2 pages, uploaded on Mar. 10, 2010 by user szetta at https://www.youtube.com/watch?v=JQzQZ5TtHuE.†
Fancy Food and Culinary Products, 24, May 1, 2010, Talcott Communications Corporation, US.†
Screen captures from YouTube video clip entitled TipSEE FoodWine, 2 pages, uploaded on Nov. 19, 2009 by user Steve LaBuzetta at https://www.youtube.com/watch?v=cYWZtK58JHQ.†

* cited by examiner
† cited by third party

*Primary Examiner* — Robert May

(57) ABSTRACT

A dispensing container is equipped with a battery powered orientation dependent illumination device.

6 Claims, 4 Drawing Sheets

ORIENTATION DEPENDENT ILLUMINATION DEVICE FOR A DISPENSING CONTAINER

BACKGROUND OF THE INVENTION

1. Field of the Invention

The present invention relates to containers used for dispensing a material. More particularly, the present invention relates to hand-held containers used for dispensing a material. Even more particularly, the present invention relates to hand-held containers for dispensing a material in a low light environment.

2. Prior Art

Conventional dispensing containers or bottles are insufficient for use in low light environments. Lack of illumination makes accurate dispensing of the container's contents to the application site very difficult. The issue is more pronounced for dispensing containers containing personal lubricants given that they are often used in low light or completely dark environments.

There is a need in the art for an improved hand-held container that provides adequate illumination of the application site. The present invention provides an inexpensive and convenient means to enable a dispensing container to illuminate an application site in a low light environment when oriented for use.

SUMMARY

It is a primary object of the present invention to provide a hand-held container that illuminates an application site for the container's contents when oriented for use.

To meet the above object of the invention, a hand-held container is disclosed that generally comprises:

(a) a power source;

(b) a means for sensing the orientation of the container with respect to gravity;

(c) an illumination device; and (c) a means for electrically connecting said power source to said illumination device, wherein the illumination device activates to illuminate the intended application site for the container's contents when said container is oriented sufficiently to dispense the contents of the container.

In a preferred embodiment the hand-held container comprises: (a) a battery; (b) a gravity switch; (c) an LED; (d) a main power switch; and (e) electrical connections between said battery, said gravity switch, said LED, and said main power switch to supply power to said LED when said main power switch is on and said container is oriented sufficiently to activate said gravity switch.

In another embodiment the hand-held container comprises: (a) a battery; (b) an inclinometer or other electronic means for measuring the direction of gravity; (c) an LED; (d) a main power switch; and (e) an electrical circuit that supplies power to said LED when said main power switch is on and said container is oriented sufficiently so that said inclinometer output reading is above some predefined value.

The features of the invention believed to be novel are set forth with particularity in the appended claims. However the invention itself, both as to organization and method of operation, together with further objects and advantages thereof may be best understood by reference to the following description taken in conjunction with the accompanying drawings.

DESCRIPTION OF THE PREFERRED EMBODIMENTS

Figure 1:
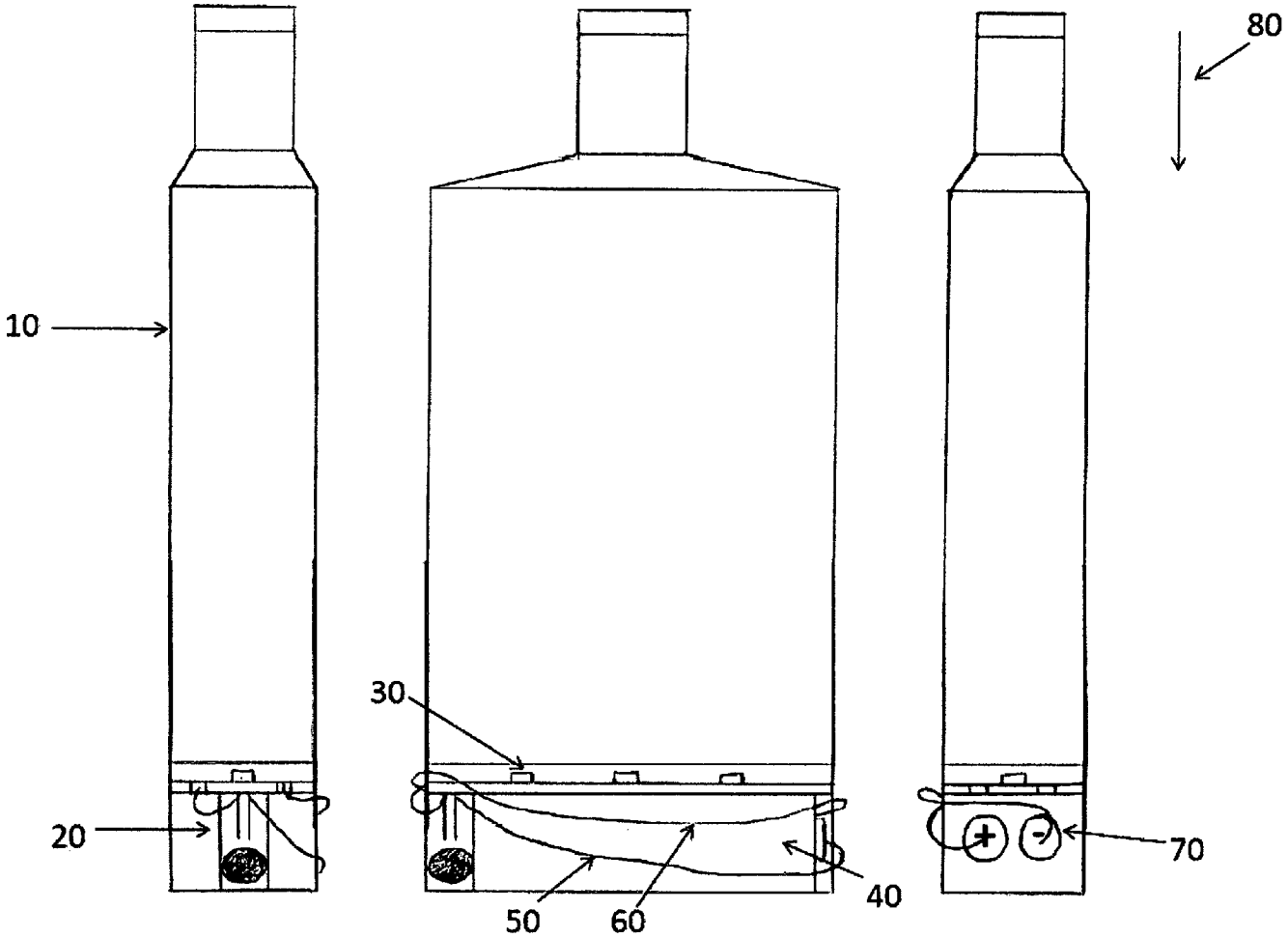
FIG. 1 shows various views of a dispensing container equipped with an LED assembly, battery, and gravity switch.

Referring to FIG. 1, a clear dispensing container 10 in accordance with the present invention comprises a gravity switch 20, an LED assembly 30, a battery 40, wires 50 and 60 in electrical connection with battery 40 and LED assembly 30, battery terminals 70, and gravity direction 80.

Figure 2:
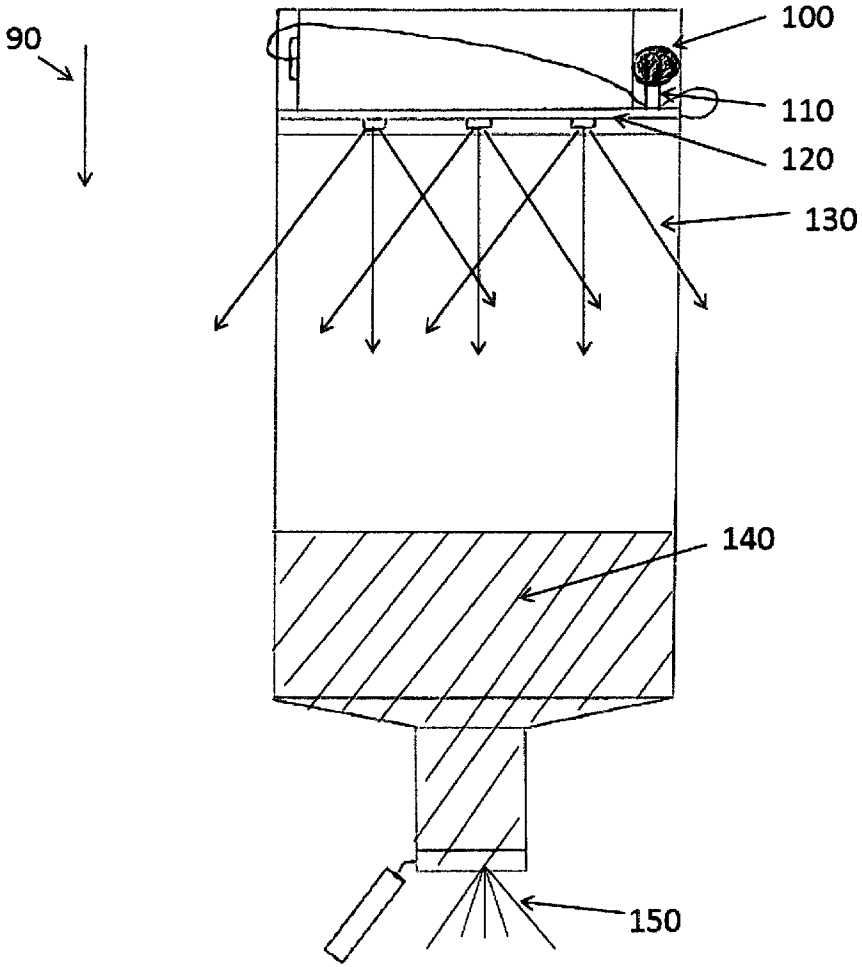
FIG. 2 shows the dispensing container in an orientation that activates the gravity switch to illuminate the LED assembly.

Referring to FIG. 2, a clear dispensing container is oriented for illuminated operation while aligned with gravity direction 90. A conductive element 100 within the gravity switch responds to gravity direction 90 to make contact with electrodes 110 to electrically connect the battery with the LED assembly 120. Light 130 is radiated through the bottle to illuminate the liquid 140 and provide adequate visualization of the dispensed liquid 150.

Figure 3:
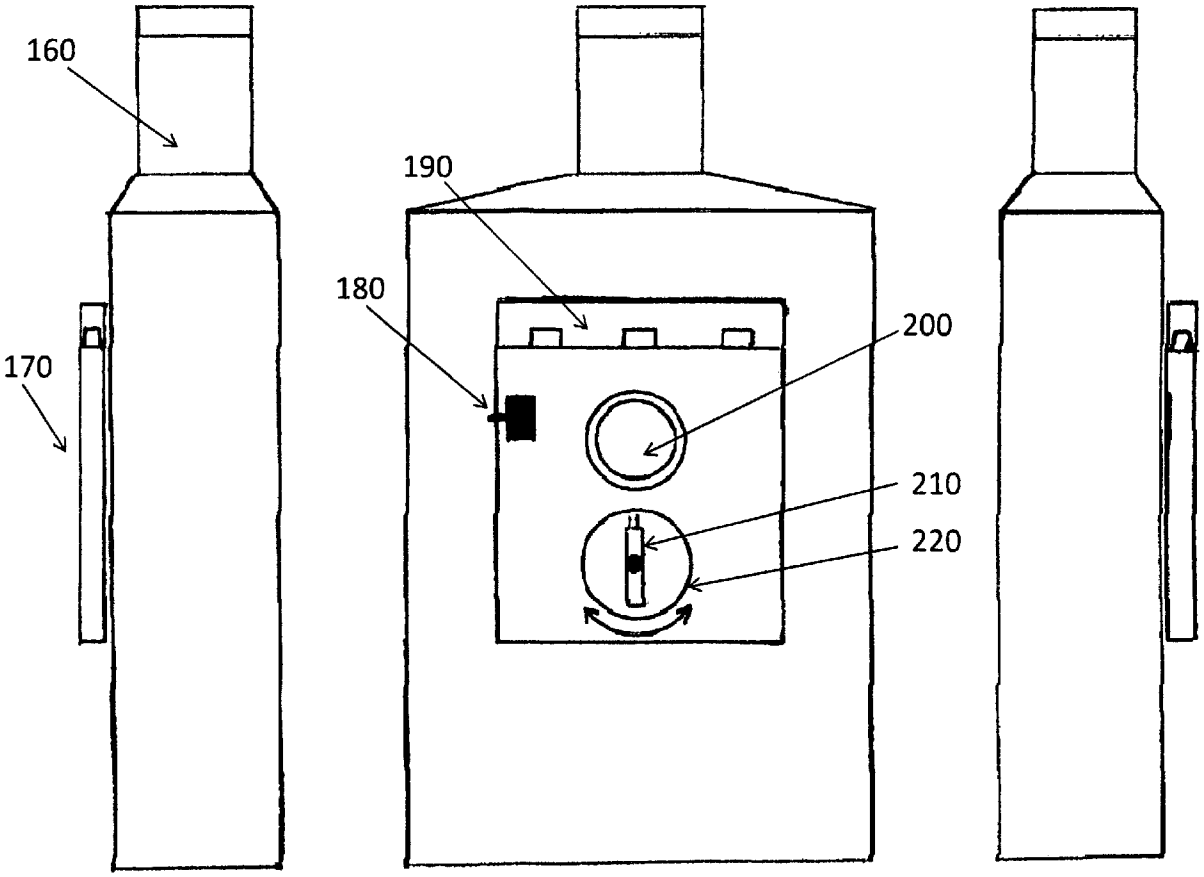
FIG. 3 shows various views of a dispensing container equipped with an LED assembly, battery, main power switch, and an adjustable gravity switch.

Referring to FIG. 3, an adhesive backed orientation dependent illumination device 170 in accordance with the present invention is affixed to a dispensing container 160. The device 170 includes a main power switch 180, an LED assembly 190, a battery 200, a gravity switch 220, and an angular adjustment means 210 for setting the activation angle for the gravity switch 210.

Figure 4:
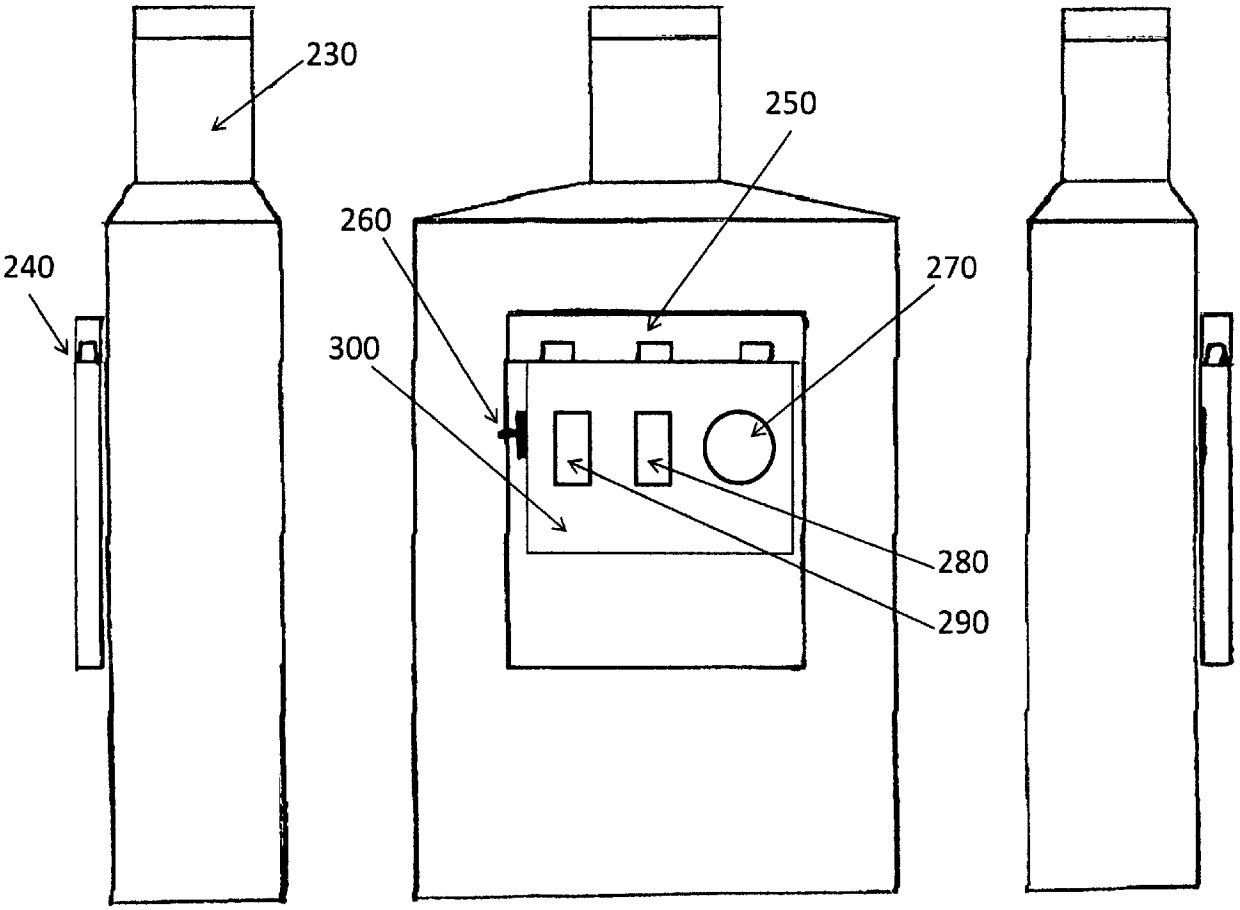
FIG. 4 shows various views of a dispensing container equipped with an LED assembly, battery, main power switch, inclinometer, microcontroller, and an electrical circuit board.

Referring to FIG. 4, an adhesive backed orientation dependent illumination device 240 is affixed to a dispensing container 230. Said device 240 includes a printed circuit assembly 300 that connects the main power switch 260, the LED assembly 250, the battery 270, the inclinometer 280, and a microcontroller 290. When the main power switch 260 is activated, the microcontroller 290 is programmed to enable power from the battery 270 to the LED assembly 250 when the inclinometer 280 has been oriented above some predefined angular threshold.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What I claim is:

1. A device attached to a hand-held container that dispenses a material comprising: (a) a power source; (b) a means for sensing the orientation of the container with respect to gravity; (c) an illumination device; (d) a means for electrically connecting said power source to said illumination device; (e) an adhesive backed attachment means for affixing said device to said container; and (f) angular adjustment means disposed on the exterior surface of said device for setting the activation orientation to a set angle, wherein said illumination device activates to illuminate the intended application site for the container's contents when said container is oriented greater than said set angle to dispense the contents of the container.

2. The device of claim 1 wherein said power source is a battery.

3. The device of claim 1 wherein said power source is a capacitor.

4. The device of claim 1 wherein said sensing means is a gravity switch.

5. The device of claim 1 wherein said sensing means is an inclinometer.

6. The device of claim 1 wherein said illumination device comprises at least one LED.

* * * * *